US008082895B2

(12) United States Patent
Yamada et al.

(10) Patent No.: US 8,082,895 B2
(45) Date of Patent: Dec. 27, 2011

(54) VARIABLE VALVE SYSTEM FOR INTERNAL COMBUSTION ENGINE AND ITS DRIVING MECHANISM

(75) Inventors: Yoshihiko Yamada, Fujisawa (JP); Akinobu Maeyama, Zama (JP)

(73) Assignee: Hitachi, Ltd., Tokyo (JP)

( * ) Notice: Subject to any disclaimer, the term of this patent is extended or adjusted under 35 U.S.C. 154(b) by 456 days.

(21) Appl. No.: 12/337,386

(22) Filed: Dec. 17, 2008

(65) Prior Publication Data

US 2009/0159026 A1 Jun. 25, 2009

(30) Foreign Application Priority Data

Dec. 19, 2007 (JP) ..... 2007-326720

(51) Int. Cl.
*F01L 1/34* (2006.01)

(52) U.S. Cl. ..... 123/90.16; 123/90.17; 123/90.31

(58) Field of Classification Search ..... 123/90.16, 123/90.39, 90.15, 90.17, 90.18, 90.27, 90.31
See application file for complete search history.

(56) References Cited

U.S. PATENT DOCUMENTS 7,077,086 B2 7/2006 Todo et al.
7,171,931 B2 2/2007 Todo et al.
7,311,070 B2 12/2007 Yamada

FOREIGN PATENT DOCUMENTS

JP 2005-273508 A 10/2005
JP 2006-2607 A 1/2006

OTHER PUBLICATIONS

U.S. Appl. No. 12/266,165, filed Nov. 6, 2008, Hara et al.
U.S. Appl. No. 12/341,668, filed Dec. 22, 2008, Nakamura.

*Primary Examiner* — Ching Chang
(74) *Attorney, Agent, or Firm* — Foley & Lardner LLP

(57) ABSTRACT

In a variable valve system for an internal combustion engine and its driving mechanism, the variable valve system comprises: a variable mechanism that revolves a control axle to change an operation characteristic of an engine valve; a projection section projected at an outer peripheral predetermined position in an axial direction of the control axle and on a tip of which a fixture section is formed; a fixture member fixed in a grasped state for the projection member via an engagement member engaged on the fixture section; a driving mechanism configured to provide a rotating force for the control axle via the fixture member; and control means (a control section) for controlling the driving mechanism in accordance with a driving state of the engine.

19 Claims, 10 Drawing Sheets

VARIABLE VALVE SYSTEM FOR INTERNAL COMBUSTION ENGINE AND ITS DRIVING MECHANISM

BACKGROUND OF THE INVENTION (1) Field of the Invention

The present invention relates to a variable valve system which is capable of modifying, for example, a valve lift (quantity) of an intake valve(s) or an exhaust valve(s) for an internal combustion engine and its driving mechanism.

(2) Description of Related Art

A Japanese Patent Application Publication No. 2005-273508 published on Oct. 6, 2005 exemplifies a previously proposed variable valve system for an internal combustion engine. The previously proposed variable valve system is applied to an intake valve side. A drive cam which is eccentric from an axial center of a drive axle is installed on an outer periphery of the drive axle revolving in synchronization with a rotation of a crankshaft. In addition, a rotating force of the drive cam is transmitted via a transmission mechanism in a multi-node link configuration and a swing cam is provided whose cam surface is slidably contacted on an upper surface of a valve lifter provided on an upper end of the intake valve to open to be operated against a biasing spring force of a valve spring.

Then, a driving mechanism including an electrically operated motor and ball screw means which is a speed-reduction mechanism varies a pivotal position of a control cam via a control axle in accordance with an engine driving state. Thus, a swing fulcrum of the transmission mechanism is varied so that a rollably contacted position of the cam surface of the swing cam against the upper surface of the valve lifter is varied. Thus, a valve lift (quantity) of the intake valve is variably controlled in accordance with the engine driving condition.

SUMMARY OF THE INVENTION

In the previously proposed variable valve system, the driving mechanism is arranged on a rear end of the control axle and is largely projected from the rear end of the engine cylinder. Hence, an axial length of the whole system becomes considerably long. Consequently, an axial length of the engine becomes accordingly long and an easiness in mounting of the whole engine on the vehicle becomes worsened.

Therefore, the driving mechanism is thought to be mounted on a middle position in an axial direction of the control axle. However, since the control axle is formed in a circular shape of cross section, there is a possibility of becoming a linkage structure to the driving mechanism complicated, manufacturing works and assembling works become complex, and a high cost of manufacturing is brought out.

It is, hence, an object of the present invention to provide a variable valve system for an internal combustion engine which are easy in manufacturing works and in assembling works and require no high cost in its manufacturing.

According to one aspect of the present invention, there is provided a variable valve system for an internal combustion engine, comprising: a variable mechanism that revolves a control axle to change an operation characteristic of an engine valve; a projection section projected at an outer peripheral predetermined position in an axial direction of the control axle and on a tip of which a fixture section is formed; a fixture member fixed in a grasped state for the projection member via an engagement member engaged on the fixture section; a driving mechanism configured to provide a rotating force for the control axle via the fixture member; and control means for controlling the driving mechanism in accordance with a driving state of the engine.

According to another aspect of the present invention, there is provided a variable valve system for an internal combustion engine, comprising: a variable mechanism that revolves a control axle to vary an operation characteristic of an engine valve; projection section projected at an outer peripheral predetermined position in an axial direction of the control axle and on a tip of which a fixture section is formed; a fixture member comprising a convex section contactable on a rotational direction side surface of the projection section and a penetrating section installed to be penetrated through a plane on which the convex section is provided and another plane opposite to the plane and which is aligned with the fixture section when the convex section is contacted against the rotational direction side surface of the projection section; an engagement member inserted into the penetrating section and engaged with the fixture section to fix the fixture member to the projection section; a driving mechanism that is swingably linked to the fixture member to provide a rotating force for the control axle via the fixture member; and a control section configured to control the driving mechanism in accordance with a driving state of the engine.

According to a still another aspect of the present invention, there is provided a driving mechanism of a variable valve system for an internal combustion engine, the variable valve system comprising a control axle including a projection section projected on a predetermined outer peripheral side in an axial direction of the control axle and on a tip of which a fixture section is formed and being configured to rotatably control the control axle to vary an operation characteristic of an engine valve and the driving mechanism comprising: an electrically operated motor; an output axle rotatably driven by means of the motor; a movement member that moves along an axial direction of the output axle in accordance with a rotation of the output axle; a fixture member comprising a convex section contactable on a rotational direction side surface of the projection section and a penetrating section installed to be penetrated through a plane on which the convex section is provided and another plane opposite to the plane and which is aligned with the fixture section when the convex section is contacted against the rotational direction side surface of the projection section; an engagement member inserted into the penetrating section and engaged with the fixture section for the fixture member to be fixed onto the projection section; and a link member that swingably links the movement member and the fixture member.

DETAILED DESCRIPTION OF THE INVENTION

Figure 1:
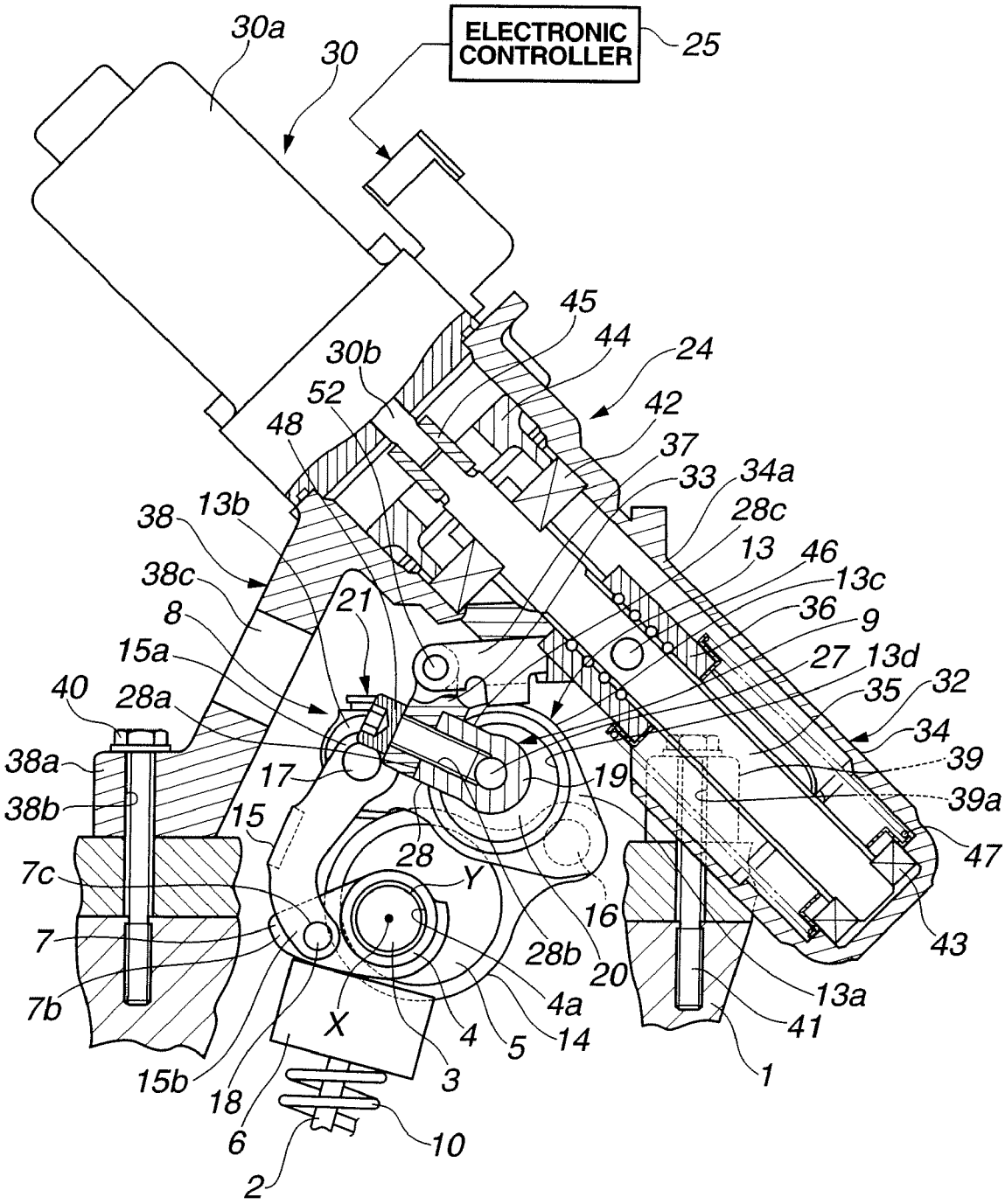
FIG. 1 is a cross sectional view representing a variable mechanism and a driving mechanism in a preferred embodiment of a variable valve system according to the present invention.

Reference will, hereinafter, be made to the drawings in order to facilitate a better understanding of the present invention. That is to say, the detailed description of a variable valve system for an internal combustion engine according to the present invention will be made on a basis of the accompanied drawings. In this embodiment, the present invention is applicable to an intake valve side of a multi-cylinder internal combustion engine. The internal combustion engine is equipped with two intake valves for each of the cylinders.

In details, as shown in FIGS. 1 through 4, the variable valve system includes: a pair of intake valves 2, 2 per cylinder slidably installed on a cylinder head 1 via a valve guide (not shown); a drive axle 3 in an internal hollow configuration and arranged in a forward-or-backward direction of the engine; a camshaft 4 arranged per cylinder and rotatably supported coaxially on an outer peripheral surface of drive axle 3; a drive cam 5 integrally fixed at a predetermined position of drive axle 3; a pair of swing cams 7, 7 which are operated to be open respective pair of intake valves 2, 2, these being slidably contacted on valve lifters 6, 6 disposed on the upper end portions of respective intake valves 2, 2; and a transmission mechanism 8 interposed between drive cam 5 and swing cams 7, 7 for the rotating force of drive cam 5 to be transmitted as a swing force (a valve open force); and a control mechanism 9 which makes an operated position of transmission mechanism 8 variable.

Respective intake valves 2, 2 are biased in their closure directions by means of valve springs 10, 10 elastically interposed between spring retainers at the upper end portions of valve stems of the intake valves 2, 2 and bottom portions of bores formed on the upper end portion of cylinder head 1. It should be noted that the variable mechanism is constituted by drive axle 3, camshaft 4, swing cam 7, transmission mechanism 8, and control mechanism 9.

Drive axle 3 is arranged along the forward-or-backward direction of the engine and includes an oil passage hole 3*a* formed to be communicated with a main oil gallery in its inner axial direction. In addition, an oil hole (not shown) is penetrated in a diameter direction of drive axle 3 at a position corresponding to a journal portion 4*b* of camshaft 4. In addition, both ends of drive axle 3 are axially and rotatably supported on a bearing (not shown) installed on an upper portion of cylinder head 1 and one of both ends of drive axle 3 is provided with a driven sprocket and a timing chain wound on the driven sprocket via both of which a rotating force is transmitted from a crankshaft of the engine.

Camshaft 4 is approximately formed in a cylindrical shape along an axial direction of drive axle 3. A supporting axial hole 4*a* rotatably supported on an outer periphery of drive axle 3 in its inner axial direction. A large-diameter cylindrical journal portion 4*b* formed at an approximately center position on an outer peripheral surface is rotatably and axially supported on a cam bearing (not shown).

Drive cam 5 has a cam main frame approximately formed in a disc shape along a diameter direction of oil holes (not shown) and an axial center Y of the cam main frame is radially offset by a predetermined quantity in a diameter direction from another axial center X of drive axle 3 and a cylindrical portion 5*a* is integrally installed on the cam main frame at one side portion of the cam main frame. Drive cam 5 is fixed onto drive axle 3 by means of a fixture section 5*b* radially drilled through cylindrical portion 5*a* and a fixture pin inserted under pressure into a fixture hole of drive axle 3 continuously formed from fixture section 5*b*.

Respective swing cams 7, 7 provide approximately droplet shapes of the same configurations and have basic end portions which swing with an axial center (X) of drive axle 3 as a center via camshaft 4. Cam surfaces 7*a* are respectively formed on their lower surfaces of swing cams 7, 7 and are contacted on upper surface predetermined positions of respective valve lifters 6, 6. A pin hole 7*c* is penetrated through a cam nose portion at a tip of one of swing cams 7.

Transmission mechanism 8 includes: a rocker arm 13 disposed on an upper portion of drive axle 3; a link arm 14 interlinked between one end portion 13*a* of rocker arm 13 and drive cam 5; and a link rod 15 interlinked between the other end portion 13*b* of rocker arm 13 and one swing cam 7.

Rocker arm 13 has a supporting hole 13*d* penetrated and formed from a lateral direction at an inside part of a cylindrical base portion 13*c* at a center thereof and is swingably supported on an outer periphery of a control cam 20 which will be described later via supporting hole 13*d*. In addition, one end portion 13*a* of rocker arm 13 has a pin integrally projected on a side portion of a tip of rocker arm 13 and the other end portion 13*b* thereof is provided with a lift adjustment mechanism 21 configured to adjust a valve lift (quantity) of intake valves 12, 12 in relation to link rod 15.

Link arm 14 includes: a large-diameter annular section 14*a*; and a projection end 14*b* projected at a predetermined position on an outer peripheral surface of annular section 14*a*. A fitting hole is formed on a center position of annular section 14*a* into which an outer peripheral surface of drive cam 5 is rotatably fitted. A pin hole is penetrated through projection end 14*b*. Pin 16 is rotatably inserted into the pin hole of projection end 14*b*.

Link rod 15 is formed in an approximately Japanese letter ㄱ shape in cross sectional surface by a press fitting and its inner side thereof is folded in an approximately Japanese letter < shape in cross sectional surface (parallel two sheets of plates) to make a compact structure and pin holes are penetrated respectively in lateral directions on two leg end portions 15*a*, 15*b* formed in approximately in letter ㄱ shape of cross sectional shape.

In addition, link rod 15 has the two-leg shaped one end portion 15*a* rotatably linked to the other end portion 13*b* of rocker arm 13 via linkage pin 17 inserted into both pin holes and lift adjustment mechanism 21. On the other hand, the other end portion 15*b* is rotatably linked to swing cam 7 via respective pin holes and linkage pins 18 inserted into pin holes 7*c* formed at cam nose section 7*b* of one swing cam 7.

Lift adjustment mechanism 21 includes: a block-formed linkage section 22 having an integrally formed at the other end portion 13*b* of rocker arm 13; a lock-purpose screw 23 screwed into a female screw hole (not shown) formed on an inner portion of linkage section 22 from an upper surface of linkage section 22; and an adjustment screw 23*a* screwed into the female screw hole from the lower side of the female screw. During the assembly of respective components of the variable mechanism, adjustment screw 23*a* is rotated so that an open valve quantity of each of swing cams 23*a* are fine adjusted by varying a length of link rod 15 for linkage section 22.

Control mechanism 9 includes: a hollow control axle 19 disposed at an upper position of drive axle 3; a control cam 20 integrally fixed on an outer periphery of control axle 19 and which is a swing fulcrum of rocker arm 13; a driving mechanism 24 which rotatably controls control axle 19; and an electronic controller 25 which is control means (a control section) for controlling driving mechanism 24 in accordance with the engine driving condition.

Control axle 19 is disposed in an engine forward-or-backward direction in parallel to drive axle 3 and is rotatably supported via a bearing portion 26 disposed on an upper end portion of cylinder head 1, as shown in FIGS. 1 through 3 and FIG. 6. A lubricating oil passage (a passage hole) 27 is formed in an inner axial center direction of control axle 19. In addition, a passage hole 19*b* of control axle 19 to communicate with lubricating oil passage 27 through a radial direction thereof is formed at a position which provides a journal section 19*a* supported on bearing section 26 of control axle 19. Thus, a space between journal section 19*a* and bearing section 26 is effectively lubricated with the lubricating oil supplied via passage hole 19*b* of control axle 19 from lubricating oil passage 27. It should be noted that bearing section 26 serves also as a bearing for drive axle 3 at its lower side.

Figure 6:
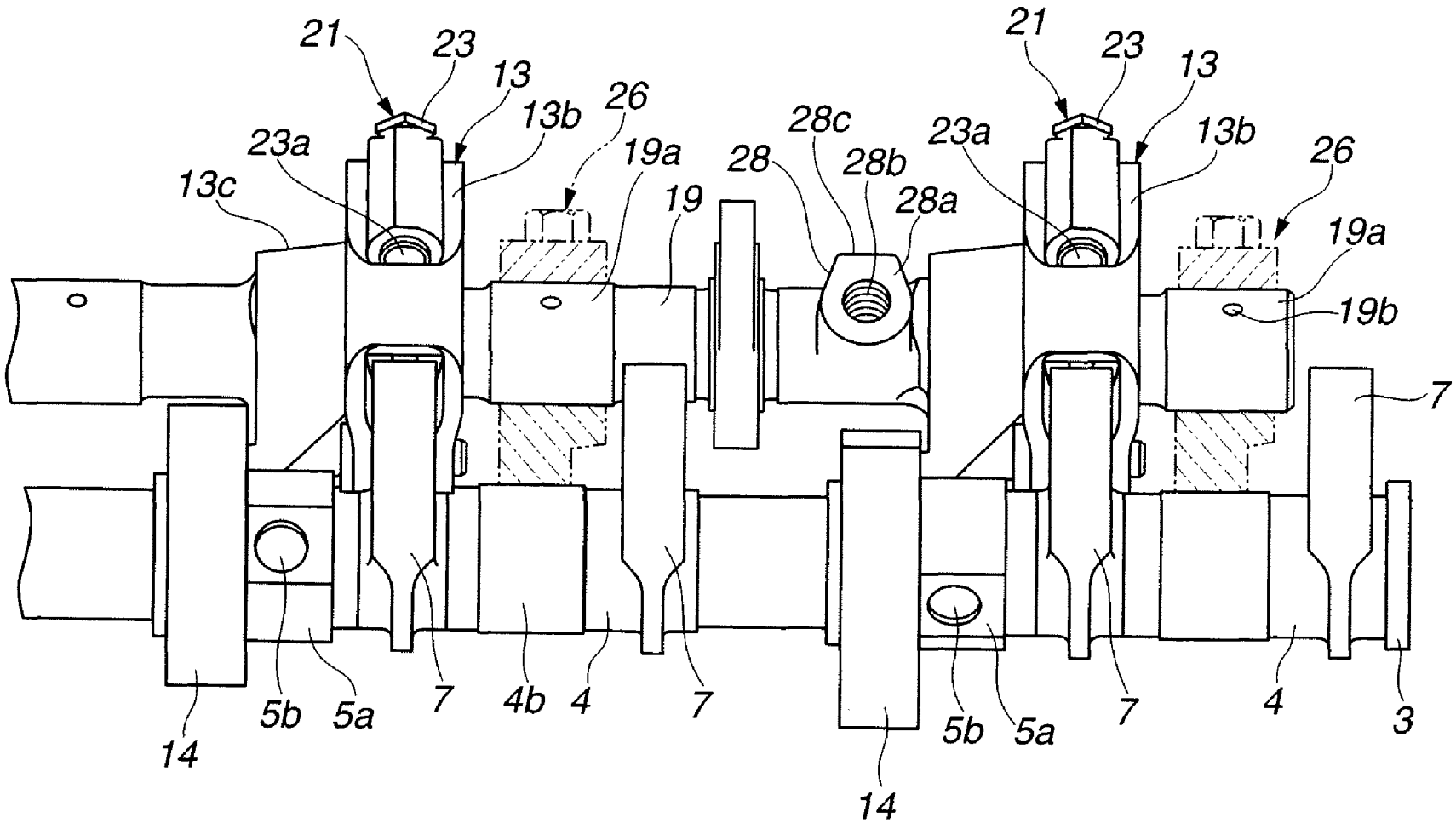
FIG. 6 is a side view representing the variable mechanism and the driving mechanism in the preferred embodiment according to the present invention.
Figure 7:
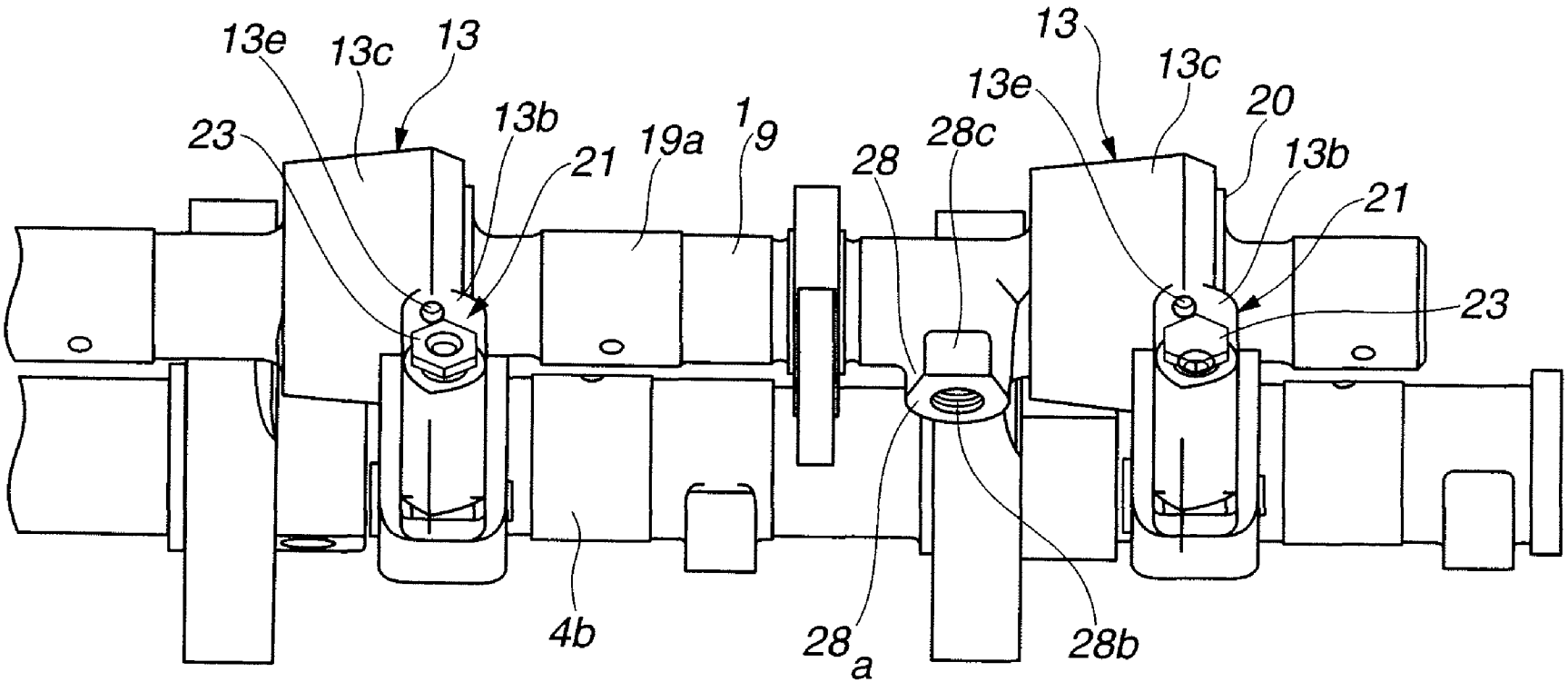
FIG. 7 is a plan view representing the variable mechanism in the preferred embodiment according to the present invention.
Figure 12:
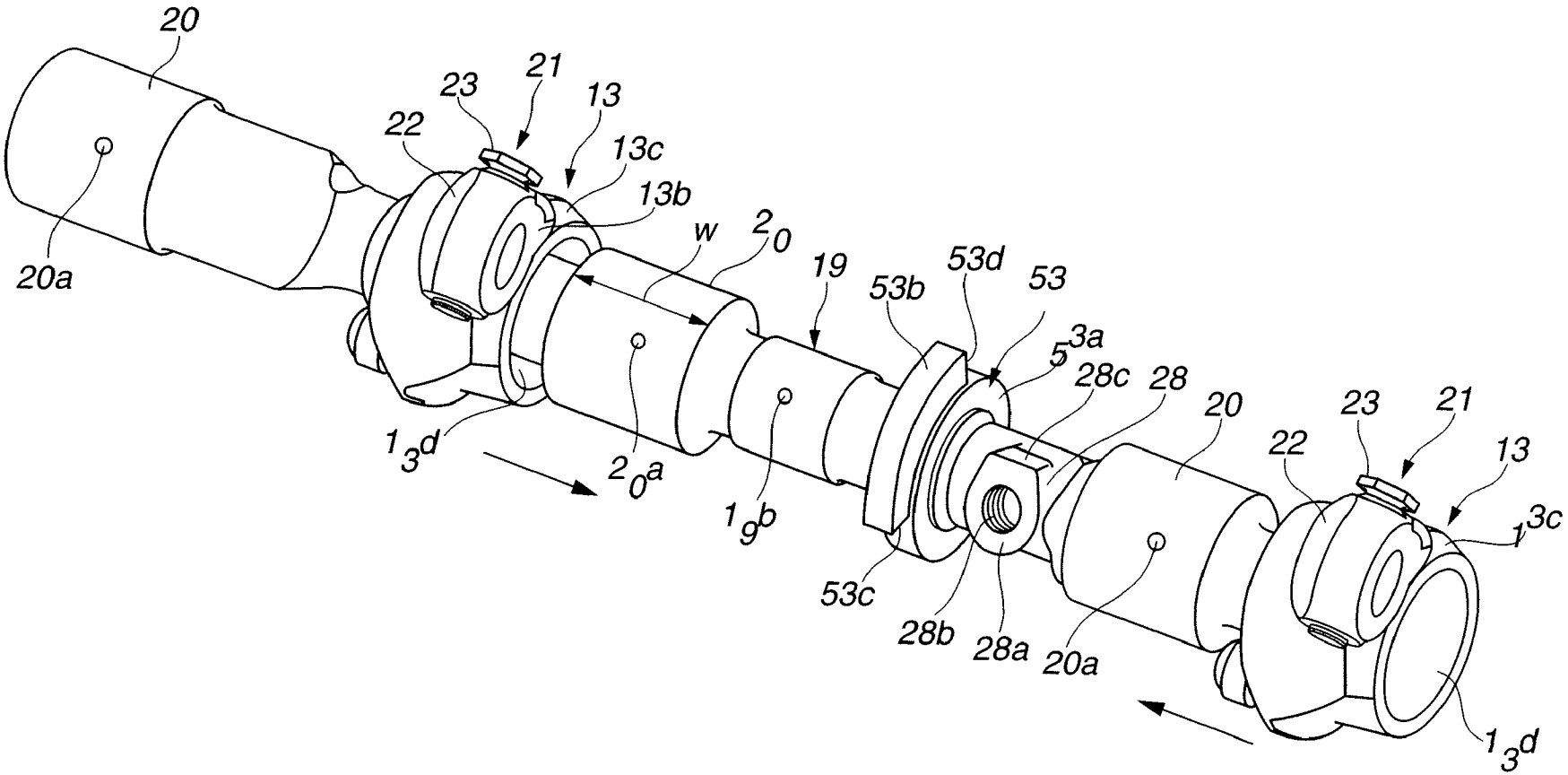
FIG. 12 is a perspective view representing a state wherein a rocker arm is assembled onto a control axle in the preferred embodiment according to the present invention.

In addition, an approximately cylindrical projection section 28 is integrally mounted on a predetermined middle position in an axial direction of control axle 19, as shown in FIGS. 6, 7, and 12. That is to say, this projection section 28 is installed at an approximately middle position between the two cylinders in the axial direction of control axle 19 and installed at a position orthogonal to the axial line of control axle 19. This projection portion is projected and formed from the outer surface of control axle 19 in the radial direction. Then, a first seat surface 28*a* in a flat surface form is formed at the tip thereof. A female screw hole 28*b* which is a fixture section is drilled in the internal axial direction from the approximately center of first seat surface 28*a*. A second seat surface 28*c* in a flat surface configuration is formed at one side section at the rotation direction side of control axle 19. Hence, an approximately L shaped seat surface is formed by first seat surface 28*a* and second seat surface 28*c*. Female screw hole 28*b* is penetrated to lubricating oil passage 27 of control axle 19.

On the other hand, control cam 20 provides a cylindrical form and its axial center position of control cam 20 is offset by a predetermined distance from the axial center of control axle 19 (by a thickness portion). An axial width W of control cam 20 is formed to have a slightly larger than a length in width of cylindrical base portion 13*c* of rocker arm 13 (a length of width of supporting hole 13*d*). Thus, an axial drop of rocker arm 13 during the operation is limited.

Lubricating oil passage 27 is communicated with the oil main gallery at which the lubricating oil pressurized and supplied from an oil pump (not shown) to each slide section. Lubricating oil passage 27 is communicated with a supporting hole 13*c* of cylindrical base section 13*c* of rocker arm 13 via an oil hole 20*e* continuously formed in the inner portion of control axle 19 and control cam 20 along the radial direction, in addition to passage hole 19*b*. Hence, an effective lubrication between the outer peripheral surface of control cam 20 and the inner peripheral surface of supporting hole 13*d* is made with the lubricating oil supplied from lubricating oil passage 27.

Furthermore, an oil hole 13*e* is penetrated along a radial direction of rocker arm 13 at the inside of cylindrical base section 13*c* and other end section 13*b* of rocker arm 13, as shown in FIG. 7. This oil hole 13*e* has one end which is appropriately aligned with and communicated with an opening of the other end of the communication passage and has the other end directed from a step-difference surface of the other end portion 13*b* toward a proximity to a head section of an adjustment screw member 23. It should be noted that the step-difference surface of other end portion 13*b* is formed in a slanted surface configuration in which both left and right sides thereof are slightly lowered with oil hole 13*e* as a center.

Figure 2:
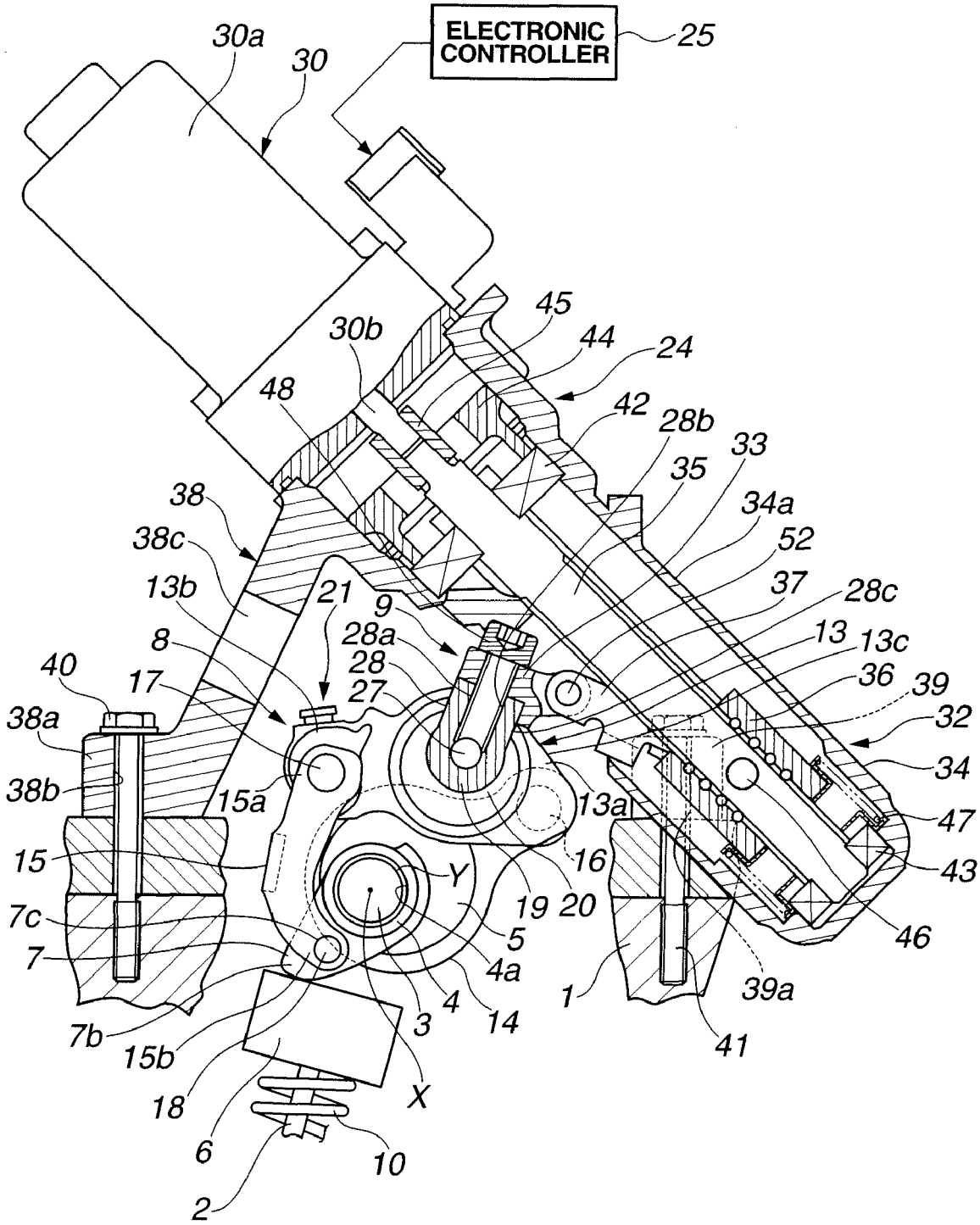
FIG. 2 is a cross sectional view representing a maximum valve lift control state in the embodiment shown in FIG. 1.

Driving mechanism 24 is arranged and fixed in the slanted form on the upper end portion of cylinder head 1 at which projection section 28 is placed along the engine width direction, as shown in FIGS. 1 and 2. Driving mechanism 24 is mainly constituted by: an electrically operated motor 30 arranged at one end side of driving mechanism 24; a ball screw transmission mechanism 32 arranged at the other end side of driving mechanism 24 which is a reduction mechanism which decelerates the rotating driving force of electrically operated motor 30; and a linkage plate 33 which is a fixture member and by which the driving force of ball screw transmission mechanism 32 is transmitted to control axle 19.

Electrically operated motor 30 is constituted by a proportional DC motor including electromagnetic coils and rotor (not shown) housed at an inside of a motor casing 30*a* and is driven through a control current outputted from electronic controller 25 detecting a driving state of the engine.

Electronic controller 25 feedbacks detection signals of various kinds of sensors such as a potentiometer and so forth to detect a rotation position of control axle 19, a crank angle sensor to detect an engine rotation speed, an airflow meter to detect an intake air quantity, and a coolant temperature sensor to detect an engine coolant temperature to detect a present engine driving condition through various kinds of logic operations and to output a control signal to electrically operated motor 30.

Ball screw transmission mechanism 32 is mainly constituted by a housing 34 coupled to motor casing 30*a* from the axial direction, a ball screw axle 35 housed within an inside of housing 34 and which is an output axle arranged approximately coaxially with a drive shaft 30*b* of electrically operated motor 30, a ball nut 36 which is a movement member screwed with an outer periphery of ball screw axle 35, and a linkage arm 37 linked via projection section 28 and linkage plate 33 with ball nut 36 and control axle 19.

Above-described housing 34 is constituted by an approximately cylindrical housing main body 34*a* housed within ball screw axle 35 as shown in FIGS. 1 though 5 and first and second brackets 38, 39 fixed on the upper end portion of cylinder head 1, as shown in FIGS. 1 through 5.

Figure 3:
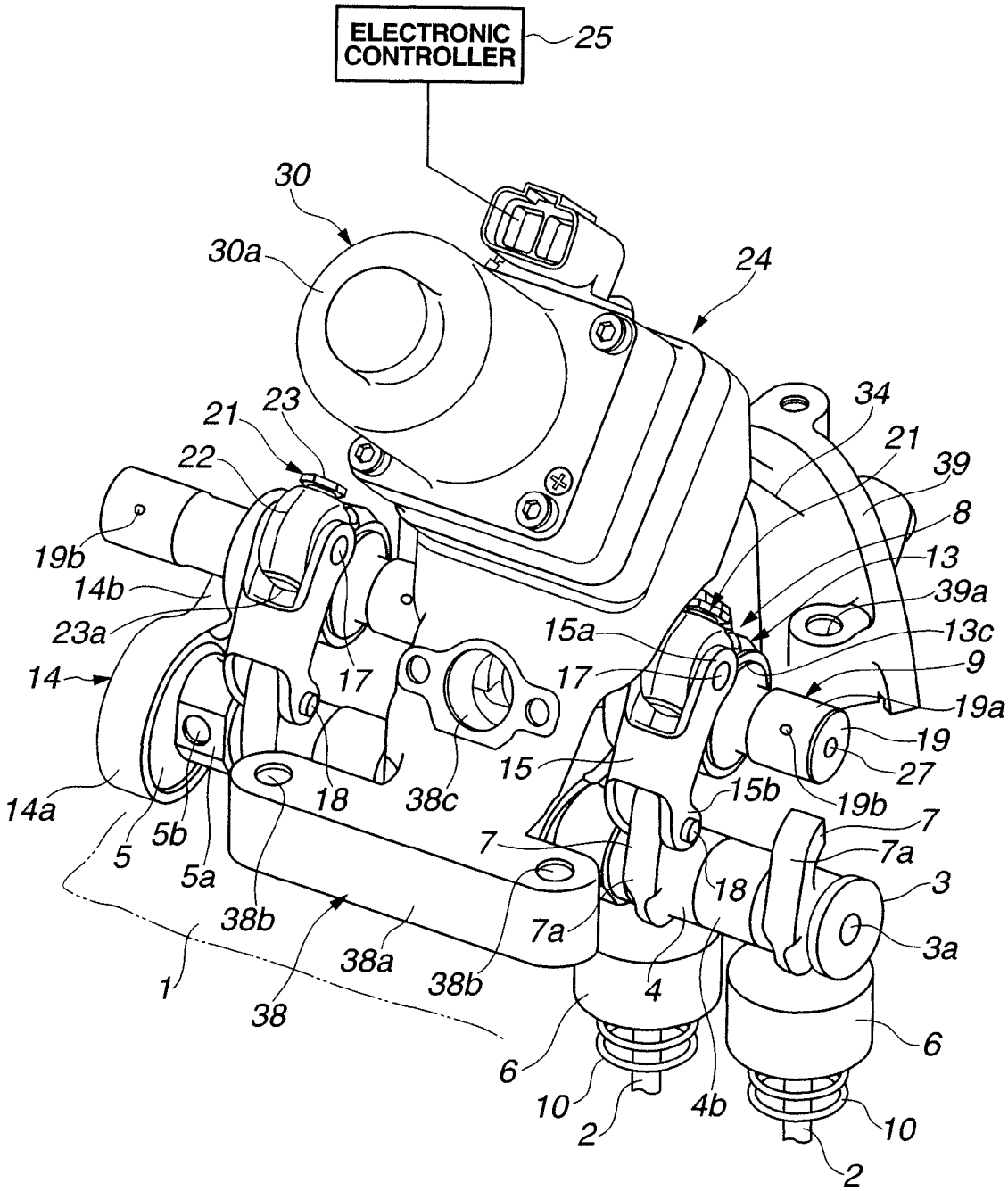
FIG. 3 is a perspective view of an essential part of the variable valve mechanism and the driving mechanism in the preferred embodiment according to the present invention.
Figure 4:
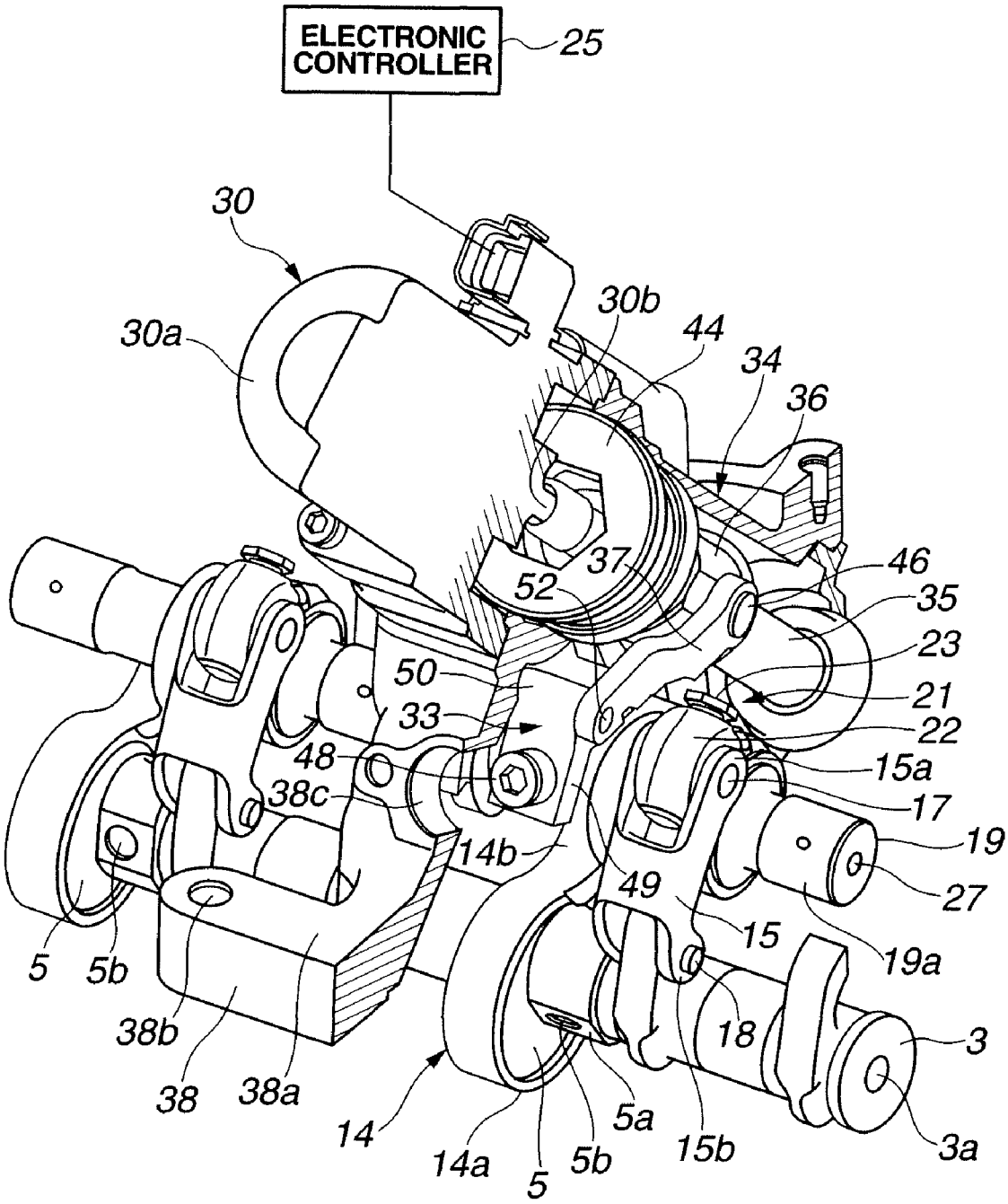
FIG. 4 is a perspective view representing a partial cross section of an essential part of the variable mechanism and the driving mechanism in the preferred embodiment according to the present invention.
Figure 5:
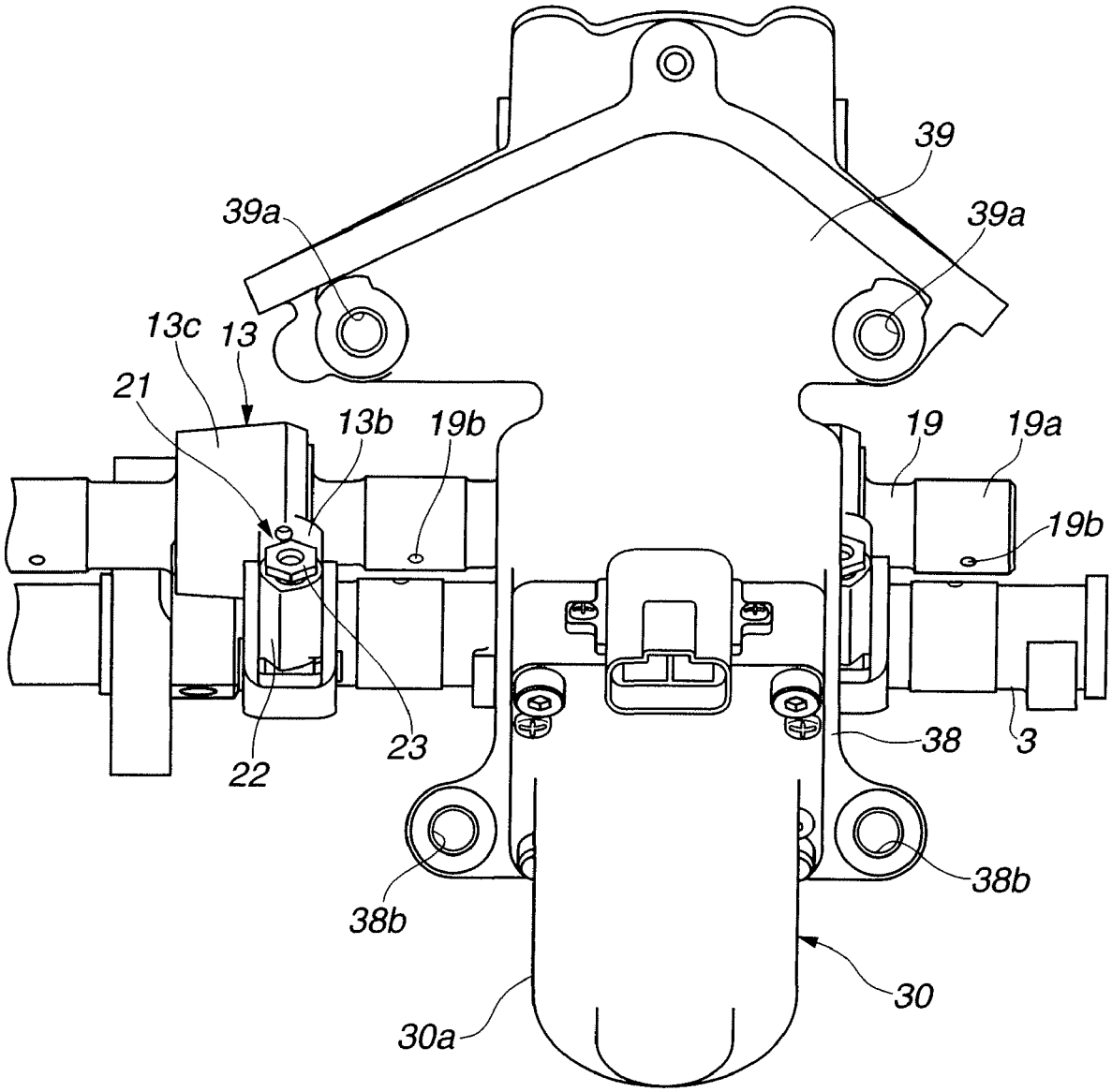
FIG. 5 is an essential part plan view of the variable mechanism and the driving mechanism in the preferred embodiment according the present invention.

First bracket 38 is formed in an approximately Japanese letter of < shape in cross section as shown in FIGS. 1, 3, and 5. Bolt penetrating holes 38*b*, 38*b* through which a pair of bolts 40, 40 are inserted to be engageably fixed onto cylinder head 1 are penetrated vertically through and formed at both sides of a lower end portion 38*a* in a long block shape. In addition, in first bracket 38, a working purpose hole 38*c* having a relatively large diameter is vertically penetrated through and formed at an approximately center position of an upper end portion 38*b* formed in a plate-like form to pass a fixture bolt 48 as will be described later to fix linkage plate 34 onto projection section 28.

On the other hand, second bracket 39 is integrally formed at both sides of housing main body 34*a* and bolt inserting holes 39*a*, 39*a* through which pair of bolts 41 are inserted are vertically penetrated to fix engageably second bracket 39 onto cylinder head 1.

Hence, driving mechanism 24 is arranged so as to cross over a part of the variable mechanism including swing cams 7, 7 and transmission mechanism 8 via respective brackets 38, 39 from an upper portion of the variable mechanism.

Ball screw axle 35 has a ball circulating groove (not shown) spirally and continuously formed which is a screw section having a predetermined width over a whole outer peripheral surface except both end portions of ball screw axle 35. Both end portions exposed respectively to one end opening portion of housing 34*a* faced toward electrically operated motor 30 and to a small-diameter portion of the other end portion of housing 34*a* are rotatably journalled by means of first and second ball bearings 42, 43. Both end portions exposed respectively to one end opening portion at electrically operated motor 30 and to a small-diameter portion of the other end portion are rotatably journalled by means of first and second ball bearings 42, 43.

First ball bearing 42 located at the side of electrically operated motor 30 has a plurality of balls rollably disposed in a one-row ball groove, an outer peripheral surface of an outer lace being fixed under pressure into an inside of a one end opening portion, and first ball bearing 42 is axially positioned by means of a bearing cap 44. On the other hand, second ball bearing 43 located at a tip side has the approximately same structure as first ball bearing 42 and has a plurality of balls rollably installed in a one-row ball groove, an outer peripheral surface of the outer lace being fixed under pressure in an inside of a small-diameter portion of another end wall.

Furthermore, a tip of one end portion of ball screw axle 35 is formed of an approximately square shape in cross sectional surface, as shown in FIGS. 1 and 2. Ball screw axle 35 is coaxially and axially movably linked with the tip of drive shaft 30*b* of electrically operated electric motor 30 by means of a linkage member 45. Such a linkage as described above causes a rotating driving force of electrically operated member 30 to be transmitted to ball screw axle 35.

Ball nut 36 is formed approximately in a cylindrical shape, has a guide groove to hold rollably the plurality of balls in association with the ball circulating groove spirally and continuously formed on an inner peripheral surface thereof, and has two deflectors attached for the circular rows of the plurality of balls to be set at front and rear positions of the axial direction of ball nut 41.

Ball nut 41 provides an axial movement force while converting a rotational movement of ball screw axle 35 into a linear movement. In addition, ball nut 41 is rotatably linked with one end portion of linkage arm 37 by means of a pivotal support pin 46 at an approximately a center position in the axial direction of ball nut 41.

In addition, an axial movement range of ball nut 41 is limited to a predetermined range by means of a flange section which will be described later. Ball nut 41 is set as follows: That is to say, intake valves 2, 2 provide minimum valve lifts at a position (a position shown in FIG. 1) by which ball nut 41 is moved toward the electrically operated motor side and provide maximum valve lifts at a position (a position shown in FIG. 2) by which ball nut 41 is moved toward second ball bearing 43 maximally. A coil spring 47 which constitutes biasing means and elastically interposed between a housing step-difference surface of ball nut 41 provided on a side of second ball bearing 43 and a spring retainer installed on one end portion of ball nut 41 serves to bias ball nut 41 toward the electrically operated motor 30. The axial centers of working purpose hole 38*c* of first bracket 38 and of female screw hole 28*b* of projection section 28 are set to be approximately located on a straight line (a dot-and-dash line) at a position at which intake valves provide the minimum valve lifts.

Figure 9:
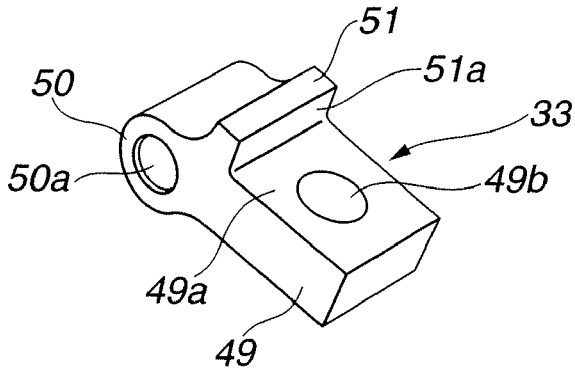
FIG. 9 is a perspective view representing a linkage plate in the preferred embodiment according to the present invention.

Linkage plate 33 is formed in approximately Japanese letter of ⌒ shape as shown in FIGS. 1, 2, and 9. Linkage plate 33 includes: a plate main frame 49 in a rectangular shape; a linkage section 50 installed integrally onto a tip of plate main frame 49; and a convex section 51 having a rectangular cross section integrally projected toward an external surface between plate main frame 49 and linkage section 50.

Plate main frame 49 is formed as a plane shaped first seating surface 49*a* at a flat upper surface thereof shown in FIG. 9 contacted against first seat surface 28*a* of projection section 28 and a bolt inserting hole 49*b* (which is a penetrating section) through which fixture bolt 48 (which is engagement means (an engagement member)) is penetrated through a center position of first seating surface 49*a*.

Linkage section 50 has an outer surface formed approximately in an arc shape and has a bolt inserting hole 50*a* in an inner width direction through which fixture bolt 48 is inserted and which is rotatably linked to the other end portion of linkage arm 37.

Convex section 51 is formed approximately in a letter L shape together with plate main frame 49 and is installed approximately in a right angle to plate main frame 49. One flat side surface thereof faced toward plate main frame 49 is formed as a second seating surface 51*a* seated on second seat surface 28*c* of projection section 28 and is functioned as a positioning stopper during the assembly of the convex section (linkage plate 33) onto projection section 28.

Then, when linkage plate 33 is fixed onto projection section 28, the lateral positioning is carried out while convex section 51 of linkage plate 33 is upside and each seating surface 49*a*, 51*a* is seated on each corresponding seat surface 28*a*, 28*c* of projection section 28. In this state, bolt penetrating hole 48*b* and female screw hole 28*b* are mutually aligned with each other.

Thereafter, while a male screw portion of fixture bolt 48 is inserted into bolt inserting hole 49*b*, male screw portion thereof is screwed into female screw hole 28*b* of projection section 28 to be engaged so that linkage plate 33 can easily and accurately be fixed to projection section 28.

Linkage arm 37 is formed approximately in an elongated two-sheet plate-like shape and has its cross section folded in approximately a Japanese letter of ⊐ shape by a press forming. One end portion of linkage arm 37 is rotatably linked via pin 46 at an approximately center portion of ball nut 36 as described above and the other portion thereof is rotatably linked to linkage plate 33 via an axial support pin 52 inserted into pin hole 50*a* of a linkage section 50. This causes the movement force in the axial direction of ball nut 36 to be transmitted for control axle 19 to be reversely and normally rotated.

Figure 8:
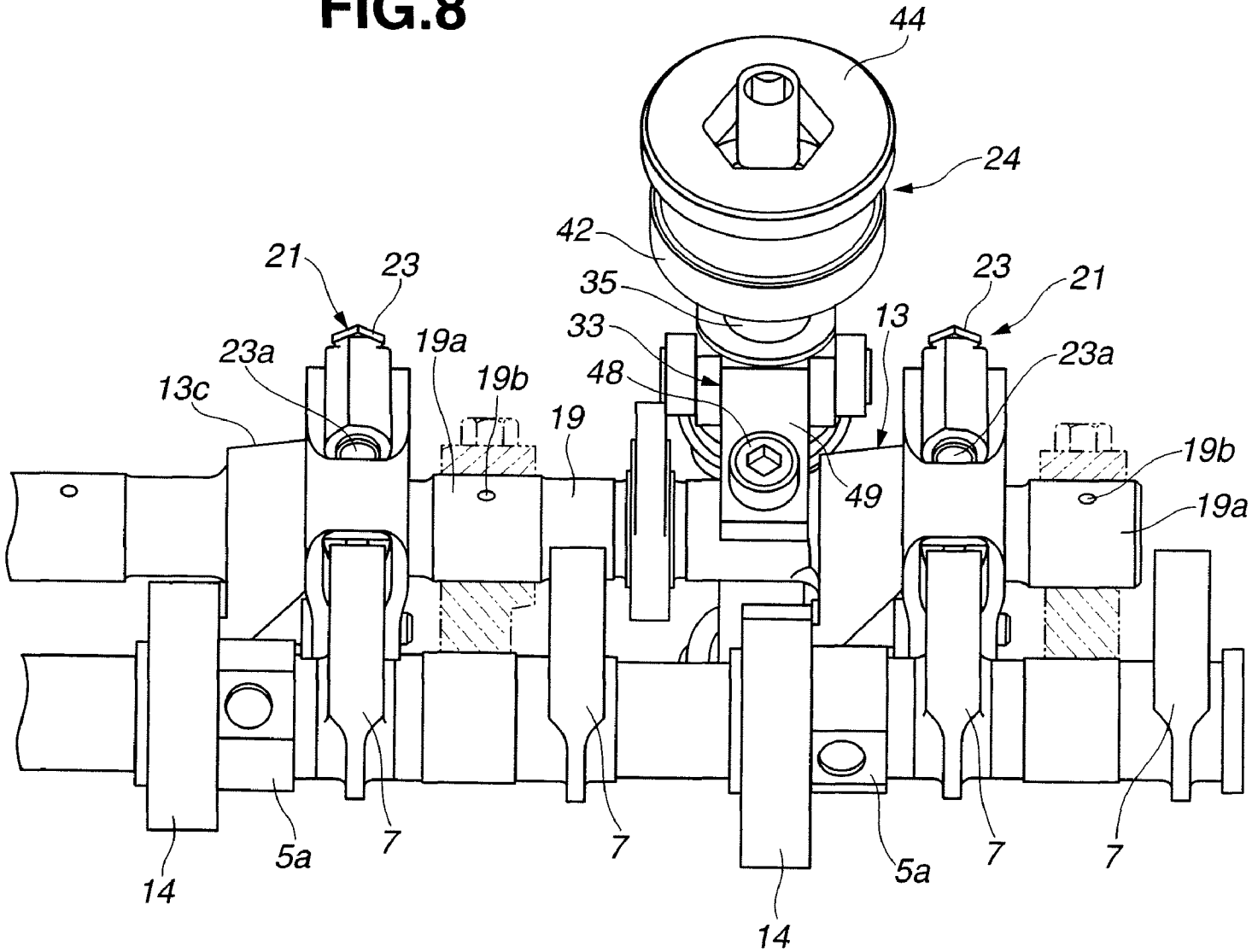
FIG. 8 is a perspective view of the essential part of the variable mechanism and a part of the driving mechanism in the preferred embodiment according to the present invention.

Furthermore, a flange portion 53 of a predetermined width is integrally mounted on a side portion of projection section 28 of control axle 19 which limits normal and reverse maximum rotation positions of control axle 19, as shown in FIGS. 8 and 12. This flange portion 53 includes: a disc-shaped flange main frame 53*a*; and an approximately sector shaped stopper section 53*b* integrally mounted on an outer periphery of flange main frame 53*b*. This flange main frame 53*a* has its lower half portion rotatably fitted into a non-contact state within semi-circular groove 1*a* formed on an upper end portion of cylinder head 1. On the other hand, an angular length of a circumferential direction of stopper section 53*b* is set to about 90 degrees. Along with the normal or reverse rotation of control axle 19, when stopper section 53*b* is normally or reversely rotated via flange main frame 53*a*, either one of both end edges 53*c*, 53*d* is contacted on either one of both end edges 1*b*, 1*c* of semi-circular arc shaped groove 1*a* so that the more rotation of control axle 19 is limited.

In addition, flange main frame 53*a* has its lower half always positioned in semi-arc groove 1*a*. Hence, when the axial directional movement force is acted upon control axle 19, either one of left and right side surfaces 53*e*, 53*f* of flange section 53 is contacted on either one of opposing both side surfaces of semi-arc groove 1*a*. Thus the axial movement of control axle 19 can be limited.

Hereinafter, a variable action of the valve lifts (quantities) of intake valves 2, 2 according to the variable mechanism will briefly be explained.

Figure 10:
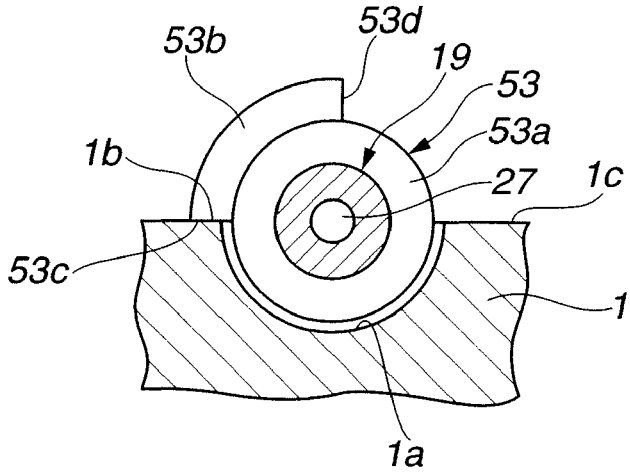
FIG. 10 is a cross sectional view representing a flange section and a semi-arc shaped groove in the preferred embodiment of the variable valve system according to the present invention.
Figure 11:
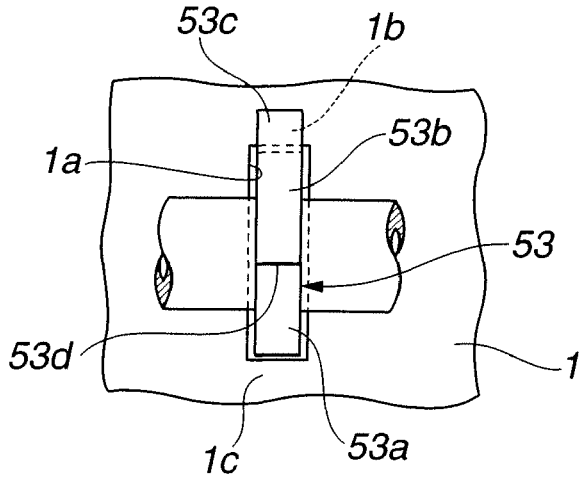
FIG. 11 is a plan view representing the flange section and the semi-arc shaped groove shown in FIG. 10.

For example, suppose that electrically operated motor 30 is rotatably driven according to a control current outputted from electronic controller 25 in a low rotation area of the engine. This rotation torque is transmitted to ball screw axle 35 to be revolved so that ball nut 36 is moved toward the position shown in FIG. 1. At this time, this movement force is transmitted to control axle 19 via linkage arm 37, linkage plate 33, and projection section 28. At this time, control axle 19 is rotatably driven in the uni-direction so as to be limited to a uni-direction maximum rotation position shown in FIG. 10 by means of stopper section 53*b*.

Hence, control cam 20 is pivoted in the uni-direction and its axial center of control cam 20 is revolved with the same radius and a thickness section thereof is spatially separated from drive axle 3 and moved in the upward direction from drive axle 3. This causes other end portion 13*b* of rocker arm 13 and an axial support point (linkage pin 17) of link rod 15 are moved in the upward direction to drive axle 3. Thus, a cam nose side of each swing arm 7 is forcibly pulled up via link rod 15.

Hence, when drive cam 5 is rotated so that one end portion 13*a* of rocker arm 13 is pushed upward via link arm 14, its lift quantity is transmitted to each swing cam 7 and each valve lifter 6. However, the lifts (lift quantities) of intake valves 2, 2 are sufficiently small.

Furthermore, in a case where the engine is transferred to a high rotation area, electrically operated motor 30 is reversely rotated according to a control axle current from electronic controller 25 so that ball screw axle 35 is revolved in the same direction. At this time, along with this rotation, control axle 19 rotates control cam 20 in the other direction so that the axial center thereof is moved in the lower direction. Thus, whole rocker arm 13 is, in turn, moved in the direction of drive axle 3 so that other end portion 13*b* of rocker arm 13 causes a cam nose portion of each swing cam 7 to be pressed in the lower direction via link rod 15. Thus, the whole of each swing cam 7 is pivoted in the anti-clockwise direction from the position shown in FIG. 1 by a predetermined quantity. Hence, as shown in FIG. 2, a contact position of cam surface 7*a* of each swing cam 7, 7 for an upper surface of each valve lifter 6 is moved at the cam nose portion side (a lift section side).

Therefore, when drive cam 5 is revolved during the open operation of each of intake valves 2, 2 (engine valve) so that one end portion 13*a* of rocker arm 13 is pushed upward via link arm 14 and valve lifts (lift quantities) of intake valves 2, 2 are made large via respective valve lifters 6.

In addition, during a stop of the engine, ball nut 36 is biased and held at the minimum valve lift position shown in FIG. 1 according to a spring force of coil spring 47. Hence, a re-start characteristic of the engine becomes favorable.

Then, according to this embodiment, driving mechanism 24 is not arranged at the end portion in the axial direction of control axle 19 but is arranged at a middle position in the axial direction described above. Thus, the elongation of the variable system in the axial direction can be suppressed and easiness in mounting of the system on the vehicle can be improved.

Then, control axle 19 is linked with linkage arm 37 of ball nut 36 via projection section 28 having a simple structure and via fixture bolt 48 and linkage plate 33. Hence, an increase in the number of parts can be suppressed. The manufacturing work and assembly work can be facilitated. A cost reduction can also be achieved.

In addition, for example, during the assembly of driving mechanism 24 on cylinder head 1, the spring force of coil spring 47 causes ball nut 36 to be held at the position shown in FIG. 1 which provides the minimum valve lift. Thus, the axial center of working purpose hole 38*c* of first bracket 38, bolt inserting hole 49*b* of linkage plate 33, and female screw hole 28*b* of projection section 28 are approximately on the same straight line. Therefore, the spiral attaching operation from an outside of fixture bolt 48 through working purpose hole 38*c* onto female screw hole 28*b* can be easily be carried out. Thus, a working efficiency of assembling each component can be improved.

The fixture of linkage plate 33 to projection section 28 is carried out by means of fixture bolt 48 so that not only an easiness in the fixing operation can be carried out but also a rigid fixation state can be obtained.

Furthermore, in this embodiment, driving mechanism 24 is attached onto cylinder head 1 in a form to cross over transmission mechanism 8, control axle 19, and so forth from the upper portion thereof via each bracket 38, 39. Thus, the attaching operation of driving mechanism 24 becomes extremely easy and driving mechanism can be attached using forward and rearward two brackets 38, 39. Hence, an attaching strength can become high.

In addition, projection section 28 is arranged adjacent to flange section 53. For example, as denoted by an arrow mark in FIG. 12, when each rocker arm 13 is assembled onto each corresponding control cam 20, each rocker arm can loosely be fitted into each corresponding control cam through both end portions of control axle 19. In details, projection section 28 and flange section 53 can be attached without hindrance of projection section 28 and flange section 53. The assembly operation can be facilitated.

Furthermore, female screw hole 28*b* of projection section 28 is extended to lubricating oil passage 27 and the lubricating oil is introduced into a space faced against a male screw portion of fixture bolt 48. Hence, a sticking of fixture bolt 48 due to erosion can be prevented.

In addition, since projection section 28 is interposed between each cylinder, namely, between a dead space of each variable mechanism in which no other parts are present. An effective utilization of the dead space can be achieved.

Furthermore, in linkage plate 33, first seating surface 49*a* of plate main frame 49 and second seating surface 51*a* of convex section 51 are seated approximately in the letter of L shape onto first and second seat surfaces 28*a*, 28*c* of projection section 28. Hence, the positioning during the assembly of linkage plate 33 onto projection section 28 becomes easy and linkage plate 33 can be held at the appropriate position due to the presence of convex section 51. In addition, it becomes easier in an assembling operation through fixture bolt 48. Furthermore, at a stage at which linkage plate 33 is assembled onto projection section 28, bolt inserting hole 49*b* and female screw hole 28*b* are aligned with each other. An engaging operation of fixture bolt 48 becomes easier.

In this embodiment, part of lubricating oil caused to flow from the main oil gallery into lubricating oil passage 27 lubricates a space between above-described journal portion 19*a* and the corresponding bearing bracket through passage hole 19*b* of control axle 19. Another part thereof is caused to flow into the communication passage.

When another end opening of the communication passage and one end opening of oil passage 13*e* are aligned with each other and are communicated with each other at a predetermined swing position of rocker arm 13, the lubricating oil is drained from the other end opening from the above-described communication passage via oil hole 13*e* of rocker arm 13 and is branched into left and right sides, with an adjacent portion to adjustment screw member 23 as a center, is transmitted over both side surfaces of linkage section 22, and is caused to flow between an outer peripheral surface of linkage pin 17 and an inner peripheral surface of each pin hole. Thus, effective and positive lubrications between both peripheral surfaces can be achieved.

Furthermore, lubricating oil drained from both peripheral surfaces of the linkage pin 17 and each pin hole is dropped through an inner surface of link rod 15 and comes in the vicinity to other end portion 15*b* of link rod 15. At this time, lubricating oil is, in turn, supplied to the outer peripheral surface of each lower side linkage pin 18 and each inner peripheral surface of pin holes 7*c* located at both sides of swing cam 7. Thus, the effective lubrication between both surfaces described above can be achieved.

Hence, a smooth operation of link rod 15 and each swing cam 7, 7 can always be achieved due to the forceful lubrication over both linkage pins 17, 18 and each corresponding pin hole.

In addition, lubricating oil flowed into the communication passage is forcibly supplied between the outer peripheral surface of control cam 20 and supporting hole 13*d*. Thus, the effective lubrication between control cam 20 and rocker arm 13 can also be carried out in the same way as described above.

The present invention is not limited to the structure of the above-described embodiment. For example, the driving mechanism and the variable mechanism can be structured to the other structure. In addition, this system can be enabled to applied to the exhaust valve side other than the intake valve side.

Furthermore, the fixture section is not limited to female screw hole 28*b*. In a case where the fixture pin is merely the engaging means, a press fit hole into which this fixture pin is press fitted may constitute the fixture section.

Hereinafter, concepts of the present invention on the variable system for the internal combustion engine and its driving mechanism will be described in details.

1) The variable valve system for the internal combustion engine comprising: a variable mechanism that revolves a control axle to change an operation characteristic of an engine valve; a projection section projected at an outer peripheral predetermined position in an axial direction of the control axle and on a tip of which a fixture section is formed; a fixture member fixed in a grasped state for the projection member via an engagement member engaged on the fixture section; a driving mechanism configured to provide a rotating force for the control axle via the fixture member; and control means for controlling the driving mechanism in accordance with a driving state of the engine.

2) The variable valve system as set forth in item 1), wherein, while the fixture section is constituted by a female screw hole, the engagement member is constituted by a fixture bolt which is screwed onto the female screw hole.

3) The variable valve system as set forth in item 2), wherein the female screw hole of the projection section is installed to be approximately orthogonal to an axial line of the control axle.

4) The variable valve system as set forth in item 3), wherein a working purpose hole is installed on a fixture bracket installed on a housing of the driving mechanism in order for the fixture bolt to be penetrated from an external in a direction of the female screw hole when the fixture bolt is screwed into the female screw hole.

5) The variable valve system as set forth in item 4), wherein the driving mechanism is configured to be operated within a predetermined operating range and the driving mechanism is configured for the working purpose hole and the female screw hole to be arranged on the same approximately straight line when the driving mechanism is operated in a uni-direction of the predetermined operating range.

6) The variable valve system as set forth in item 5), wherein the driving mechanism is provided with biasing means for biasing the driving mechanism to be operated in the uni-direction.

7) The variable valve system as set forth in item 6), wherein the variable mechanism is configured to variably control a lift of the engine valve and a position at which the working purpose hole and the female screw hole are arranged on the same approximately straight line is in a controlled state wherein the driving mechanism is controlled in a minimum lift of the engine valve via the variable mechanism.

8) The variable valve system as set forth in item 4), wherein a housing of the driving mechanism is fixed to an engine main frame in a state in which the housing crosses over the variable valve system.

9) The variable valve system as set forth in item 1), wherein a passage hole through which a lubricating oil is caused to flow is formed in an inner axial direction of the control axle and the passage hole is communicated with the fixture section.

10) The variable valve system as set forth in item 1), wherein the variable mechanism includes: a drive axle to which a rotating force is transmitted from a crankshaft; a drive cam revolving integrally to the drive axle; and a swing cam operated to open the engine valve through a swing movement thereof according to a rotating force of the drive cam, and wherein a swing state of the swing cam is varied according to the rotation of a control cam installed on the control axle to change the operated state of the engine valve.

11) The variable valve system as set forth in item 10), wherein a flange section is adjoined to an axial side section of the projection section of the control axle to limit a movement of the control axle in an axial direction of the control axle.

12) The variable valve system as set forth in item 10), wherein a flange section is adjoined to an axial side section of the projection section of the control axle to limit a maximum rotation position of the control axle.

13) The variable valve system as set forth in item 1), wherein the driving mechanism comprises: an electrically operated motor; an output axle that is rotatably driven by means of the electrically operated motor; a movement member configured to move along an axial direction of the output axle in accordance with a rotation of the output axle; and a linkage arm that swingably links the movement member and the fixture member.

14) The variable valve system as set forth in item 1), wherein the variable mechanism is installed on each of a plurality of adjacently installed cylinders and the projection section is interposed between the mutually adjacent variable mechanisms.

15) The variable valve system as set forth in item 13), wherein the variable mechanism comprises: a drive axle to which a rotating force is transmitted from an engine crankshaft; a drive cam that is revolved integrally to the drive axle; a rocker arm swingably installed with a control cam installed on the control axle as a fulcrum to perform a swing movement according to a rotation of the drive cam; and a swing cam that is swung according to the swing movement of the rocker arm to be operated to open the engine valve which swingably opens, and wherein the projection section is installed at a position in the axial direction of the control axle which corresponds to the drive cam.

16) The variable valve system for the internal combustion engine, comprising: a variable mechanism that revolves a control axle to vary an operation characteristic of an engine valve; a projection section projected at an outer peripheral predetermined position in an axial direction of the control axle and on a tip of which a fixture section is formed; a fixture member comprising a convex section contactable on a rotational direction side surface of the projection section and a penetrating section installed to be penetrated through a plane on which the convex section is provided and another plane opposite to the plane and which is aligned with the fixture section when the convex section is contacted against the rotational direction side surface of the projection section; an engagement member inserted into the penetrating section and engaged with the fixture section to fix the fixture member to the projection section; a driving mechanism that is swingably linked to the fixture member to provide a rotating force for the control axle via the fixture member; and a control section configured to control the driving mechanism in accordance with a driving state of the engine.

17) The variable valve system for the internal combustion engine as set forth in item 16), wherein a seat surface is formed on the rotational direction side surface of the projection section.

18) The variable valve system for the internal combustion engine as set forth in item 17), wherein a seating surface that takes a seat on the seat surface is formed on a portion of the convex section of the fixture member.

19) The variable valve system for the internal combustion engine as set forth in item 18), wherein the seat surface provided on the projection section and the seating surface provided on the fixture member are formed in a plane configuration along an axial line of the control axle.

20) The driving mechanism of the variable valve system for the internal combustion engine, the variable valve system comprising a control axle including a projection section projected on a predetermined outer peripheral side in an axial direction of the control axle and on a tip of which a fixture section is formed and being configured to rotatably control the control axle to vary an operation characteristic of an engine valve and the driving mechanism comprising: an electrically operated motor; an output axle rotatably driven by means of the motor; a movement member that moves along an axial direction of the output axle in accordance with a rotation of the output axle; a fixture member comprising a convex section contactable on a rotational direction side surface of the projection section and a penetrating section installed to be penetrated through a plane on which the convex section is provided and another plane opposite to the plane and which is aligned with the fixture section when the convex section is contacted against the rotational direction side surface of the projection section; an engagement member inserted into the penetrating section and engaged with the fixture section for the fixture member to be fixed onto the projection section; and a link member that swingably links the movement member and the fixture member.

This application is based on a prior Japanese Patent Application No. 2007-326720 filed in Japan on Dec. 19, 2007. The entire contents of Japanese Patent Applications No. 2007-326720 with a filing date of Dec. 19, 2007 are hereby incorporated by reference. Although the invention has been described above by reference to certain embodiments of the invention, the invention is not limited to the embodiment described above. Modifications and variations of the embodiments described above will occur to those skilled in the art in light of the above teachings. The scope of the invention is defined with reference to the following claims.

What is claimed is:

1. A variable valve system for an internal combustion engine, comprising:

a variable mechanism that revolves a control axle to change an operation characteristic of an engine valve;

a seat surface projected at an outer peripheral predetermined position in an axial direction of the control axle and on a tip of which a fixture section is formed;

a fixture member fixed in a grasped state for the seat surface via an engagement member engaged on the fixture section;

a driving mechanism configured to provide a rotating force for the control axle via the fixture member; and a control device configured to control the driving mechanism in accordance with a driving state of the engine, wherein the fixture section comprises a female screw hole and the engagement member comprises a fixture bolt which is screwed into the female screw hole, and wherein the female screw hole of the seat surface is installed to be orthogonal to an axial line of the control axle.

2. The variable valve system as claimed in claim 1, wherein the seat surface includes a projection section.

3. The variable valve system as claimed in claim 1, wherein a working purpose hole is installed on a fixture bracket installed on a housing of the driving mechanism such that the fixture bolt to be penetrated from an external area towards a direction of the female screw hole when the fixture bolt is screwed into the female screw hole.

4. The variable valve system as claimed in claim 3, wherein the driving mechanism is configured to be operated within a predetermined operating range and the driving mechanism is configured for the working purpose hole and the female screw hole to be arranged on a same straight line when the driving mechanism is operated in a uni-direction of the predetermined operating range.

5. The variable valve system as claimed in claim 4, wherein the driving mechanism is provided with biasing means for biasing the driving mechanism to be operated in the uni-direction.

6. The variable valve system as claimed in claim 5, wherein the variable mechanism is configured to variably control a lift of the engine valve and a position at which the working purpose hole and the female screw hole are arranged on the same straight line is in a controlled state, wherein the driving mechanism is controlled in a minimum lift of the engine valve via the variable mechanism.

7. The variable valve system as claimed in claim 3, wherein a housing of the driving mechanism is fixed to an engine main frame in a state in which the housing crosses over the variable valve system.

8. The variable valve system as claimed in claim 1, wherein a passage hole through which a lubricating oil is caused to flow is formed in an inner axial direction of the control axle and the passage hole is communicated with the fixture section.

9. The variable valve system as claimed in claim 1, wherein the variable mechanism includes: a drive axle to which a rotating force is transmitted from a crankshaft; a drive cam revolving integrally to the drive axle; and a swing cam operated to open the engine valve through a swing movement thereof according to a rotating force of the drive cam, and wherein a swing state of the swing cam is varied according to the rotation of a control cam installed on the control axle to change the operated state of the engine valve.

10. The variable valve system as claimed in claim 9, wherein a flange section is adjoined to an axial side section of the seat surface of the control axle to limit a movement of the control axle in the axial direction of the control axle.

11. The variable valve system as claimed in claim 9, wherein a flange section is adjoined to an axial side section of the seat surface of the control axle to limit a maximum rotation position of the control axle.

12. The variable valve system as claimed in claim 1, wherein the driving mechanism comprises: an electrically operated motor; an output axle that is rotatably driven by the electrically operated motor; a movement member configured to move along an axial direction of the output axle in accordance with a rotation of the output axle; and a linkage arm that swingably links the movement member and the fixture member.

13. The variable valve system as claimed in claim 12, wherein the variable mechanism comprises: a drive axle to which a rotating force is transmitted from an engine crankshaft; a drive cam that is revolved integrally with the drive axle; a rocker arm swingably installed with a control cam installed on the control axle as a fulcrum to perform a swing movement according to a rotation of the drive cam; and a swing cam that is swung according to the swing movement of the rocker arm to be operated to open the engine valve which swingably opens, and wherein the seat surface is installed at a position in the axial direction of the control axle which corresponds to the drive cam.

14. The variable valve system as claimed in claim 1, wherein the variable mechanism is installed on each of a plurality of adjacently installed cylinders and the seat surface is interposed between the mutually adjacent variable mechanisms.

15. A variable valve system for an internal combustion engine, comprising:

a variable mechanism that revolves a control axle to vary an operation characteristic of an engine valve;

a seat surface projected at an outer peripheral predetermined position in an axial direction of the control axle and on a tip of which a fixture section is formed;

a fixture member comprising a convex section contactable on a rotational direction side surface of the seat surface and a penetrating section installed to be penetrated through a plane on which the convex section is provided and another plane opposite to the plane and which is aligned with the fixture section when the convex section is contacted against the rotational direction side surface of the seat surface;

an engagement member inserted into the penetrating section and engaged with the fixture section to fix the fixture member to the seat surface;

a driving mechanism that is swingably linked to the fixture member to provide a rotating force for the control axle via the fixture member; and a control section configured to control the driving mechanism in accordance with a driving state of the engine.

16. The variable valve system for the internal combustion engine as claimed in claim 15, wherein the seat surface is comprises a projection section.

17. The variable valve system for the internal combustion engine as claimed in claim 16, wherein a portion of the convex section of the fixture member includes a seating surface that takes a seat on the seat surface.

18. The variable valve system for the internal combustion engine as claimed in claim 17, wherein the seat surface and the seating surface provided on the fixture member are formed in a plane configuration along the axial direction of the control axle.

19. A driving mechanism of a variable valve system for an internal combustion engine, the variable valve system comprising a control axle including a seat surface projected on a predetermined outer peripheral side in an axial direction of the control axle and on a tip of which a fixture section is formed and being configured to rotatably control the control axle to vary an operation characteristic of an engine valve, the driving mechanism comprising:

an electrically operated motor;

an output axle rotatably driven by the motor;

a movement member that moves along an axial direction of the output axle in accordance with a rotation of the output axle;

a fixture member comprising a convex section contactable on a rotational direction side surface of the seat surface and a penetrating section installed to be penetrated through a plane on which the convex section is provided and another plane opposite to the plane and which is aligned with the fixture section when the convex section is contacted against the rotational direction side surface of the seat surface;

an engagement member inserted into the penetrating section and engaged with the fixture section for the fixture member to be fixed onto the seat surface; and a link member that swingably links the movement member and the fixture member.

* * * * *